US010059493B1

(12) United States Patent
Anderson

(10) Patent No.: US 10,059,493 B1
(45) Date of Patent: Aug. 28, 2018

(54) MODIFIED BLISTER BLAST DISPENSING CAPSULE

(71) Applicant: Michael Anderson, Hillsboro Beach, FL (US)

(72) Inventor: Michael Anderson, Hillsboro Beach, FL (US)

( * ) Notice: Subject to any disclaimer, the term of this patent is extended or adjusted under 35 U.S.C. 154(b) by 0 days.

(21) Appl. No.: 15/019,297

(22) Filed: Feb. 9, 2016

Related U.S. Application Data

(60) Provisional application No. 62/115,188, filed on Feb. 12, 2015.

(51) Int. Cl.
*B65D 51/28* (2006.01)
*B65D 81/32* (2006.01)

(52) U.S. Cl.
CPC ..... *B65D 51/2821* (2013.01); *B65D 81/32* (2013.01)

(58) Field of Classification Search
CPC .... A61J 1/14; A61J 1/20; A61J 1/2093; A61J 1/2089; B65D 23/04; B65D 51/28; B65D 51/2821; B65D 81/32; B65D 25/085
USPC ..... 206/219, 221, 222
See application file for complete search history.

(56) References Cited

U.S. PATENT DOCUMENTS 2,653,611 A * 9/1953 Smith ..... B65D 51/2842 206/219
8,839,826 B2 * 9/2014 Eidam ..... A61J 1/2089 141/1
9,193,517 B2 * 11/2015 Fontana ..... B65D 51/2821
2004/0026270 A1 * 2/2004 Liang ..... B65D 51/2821 206/219
2014/0209490 A1 * 7/2014 McKeown ..... B65D 51/2821 206/222
2015/0090617 A1 * 4/2015 Reza ..... B65D 25/085 206/221

FOREIGN PATENT DOCUMENTS

DE 102010022945 * 12/2011 ..... B65D 51/2828
WO WO 03051744 A1 * 6/2003 ..... B65D 51/2821

* cited by examiner

*Primary Examiner* — Bryon Gehman

(74) *Attorney, Agent, or Firm* — Malin Haley DiMaggio & Bowen, P.A.

(57) ABSTRACT

A dispensing capsule having a cap body, a bulbous actuator, and a sealing member. The cap body has a lip around its top portion that includes an annular groove on its underside. The bulbous actuator has a perimeter lip around its bottom portion, the perimeter lip having an annular protrusion extending upward. The bulbous actuator is attached to the underside of the cap body such that the annular protrusion of the bulbous actuator engages said annular groove of the cap body. The sealing member is disposed across the bottom portion of the bulbous actuator such that the perimeter lip of the bulbous actuator is disposed between the sealing member the lip of the cap body. The sealing member is configured to rupture upon application of force to the bulbous actuator causing an ingredient in the ingredient storage chamber to be dispensed from the capsule.

5 Claims, 4 Drawing Sheets

MODIFIED BLISTER BLAST DISPENSING CAPSULE

CROSS REFERENCE TO RELATED APPLICATIONS

This application claims priority to U.S. Provisional Patent Application Ser. No. 62/115,188 filed on Feb. 12, 2015.

STATEMENT REGARDING FEDERALLY SPONSORED RESEARCH OR DEVELOPMENT

N/A

BACKGROUND OF THE INVENTION

Field of the Invention

The present invention generally relates generally to dispenser capsules for various ingredients and more particularly to a blister blast dispensing capsule for use on a variety of containers.

Description of Related Art

Most if not all liquids, creams, gels and even certain powders and other substances are formulated and created for the longest shelf life and not necessarily for optimal performance and/or usefulness. There are many ingredients and/or combinations of ingredients that have reduced shelf life due to requiring combinations of liquid substances. In most all cases when any ingredients are exposed to one another, including air, deterioration begins and the clock on the limited shelf life starts. Also in most products in any category, "Shelf Life" is the key factor with respect expiration dates based on the product and category.

Several attempts have been made to design capsules and containers to improve the shelf life of compositions such as gels, liquids, powders and the like however the majority of the available device rely on a plurality of interconnected parts which are not cost effect to manufacture and assemble. The present invention is designed to be inexpensive to mass produce, fill and seal to be able to deliver an affordable dispensing capsule in virtually any application and category. This invention can be made from a one piece mold or more pieces depending on the desired application with features and benefits for keeping ingredients separate and fresh until time of use. This invention allows formulas and new products in any categories to be invented and made for desired end effects and not for what has to be done do to normal packaging and manufacturing and eliminating many unhealthy ingredients that are currently and normally used to produce most products. The present invention, therefore, is useful for packaging ingredients such as enzymes, calcium and magnesium with bio flavinoids vitamin C, probiotics creatine and many more. Moreover, the present invention allows for the mixing of a plurality of ingredients by providing a multi-chambered dispenser configuration. This provides a substantial improvement over the prior art with respect to shelf life and overall versatility.

It is, therefore, to the effective resolution of the aforementioned problems and shortcomings of the prior art that the present invention is directed. However, in view of the dispensing capsules and related devices in existence at the time of the present invention, it was not obvious to those persons of ordinary skill in the pertinent art as to how the identified needs could be fulfilled in an advantageous manner.

SUMMARY OF THE INVENTION

The present invention discloses a dispensing capsule having a cap body, a bulbous actuator, and a sealing member. The bulbous actuator is attached to underside surface of the cap body and the sealing member is disposed in the cap body adjacent to a bottom portion of the bulbous actuator. The actuator and the sealing member defining an ingredient storage chamber containing an ingredient or combination of ingredients to be dispensed into a target container. The sealing member is configured to rupture upon application of manual force to the bulbous actuator causing the ingredient or ingredients in the ingredient storage chamber to be dispensed from the capsule. In some embodiments, the cap body includes a lip wherein the bulbous actuator is attached to an underside of the lip and the sealing member is attached across a perimeter lip of the bulbous actuator. The perimeter lip of the bulbous actuator has an annular protrusion, that is configured to be received into an annual groove on said underside of the lip of the cap body.

In some embodiments, the cap body is configured to be removably attached to a secondary, target container such that said ingredient in the ingredient storage chamber is dispensed into the secondary container. Accordingly, in some embodiments, the cap body includes internal threads to engage the secondary container. In some embodiments, the capsule includes a cover received over the bulbous actuator and removably attached to the cap body.

DETAILED DESCRIPTION

Figure 1:
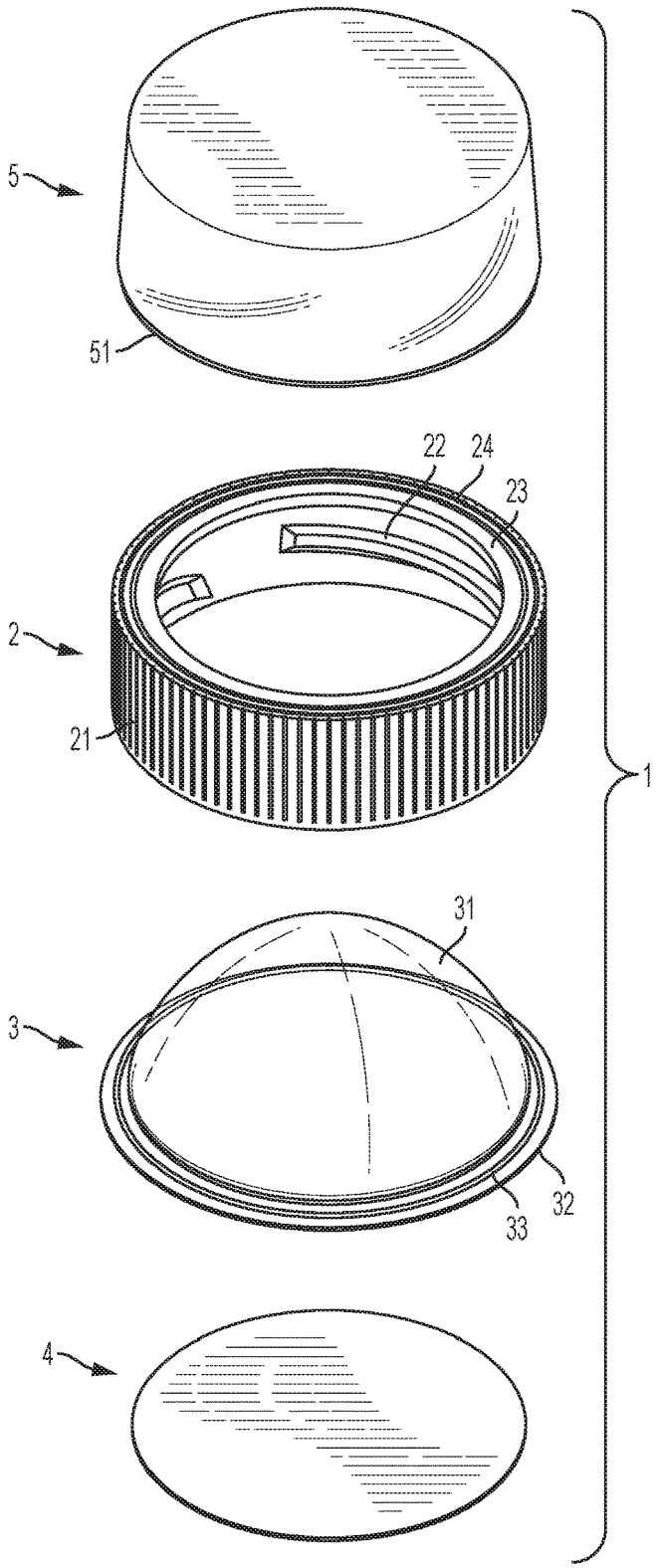
FIG. 1 is an exploded view of one embodiment of the dispensing capsule.

FIG. 1 is a front perspective view of one aspect of the dispensing capsule of the present invention in an exploded view. The dispensing capsule 1 comprises a cap body 2, a bulbous actuator 3, a sealing member 4, and a cover 5. In some embodiments, cap body 2 is a generally cylindrical ring or annulus-shaped element although other shapes and configurations are contemplated such as squares, polygons, and the like. Cap body 2 includes internal threads 22 and an outer gripping surface 21. Internal threads 22 are configured to engage a threaded top or spout of a target or secondary container 6 (FIG. 3) as further described herein. Cap body 2 further includes at its top portion a lip 23 which includes an outer circumferential groove 24. The groove 24 is coaxial with respect to the cap body 2. Bulbous actuator 3 is flexible and has a generally hemi-spherical actuator button 31. The actuator 3 includes a perimeter lip 32 around the bottom portion of the button 31. The perimeter lip 32 includes an annular protrusion 33 extending upward therefrom. Cover 5 is generally cylindrical or conical and includes a lower edge 51. Cover 5 is configured to be received over the bulbous actuator 3 and removably attached to the cap body 2. In some embodiments, lower edge 51 is received in groove 24 of the cap body 2. In other embodiments, cover 5 is semi-permanently attached to the cap body 2 by a line of weakening material or other removable and/or frangible element.

Figure 2:
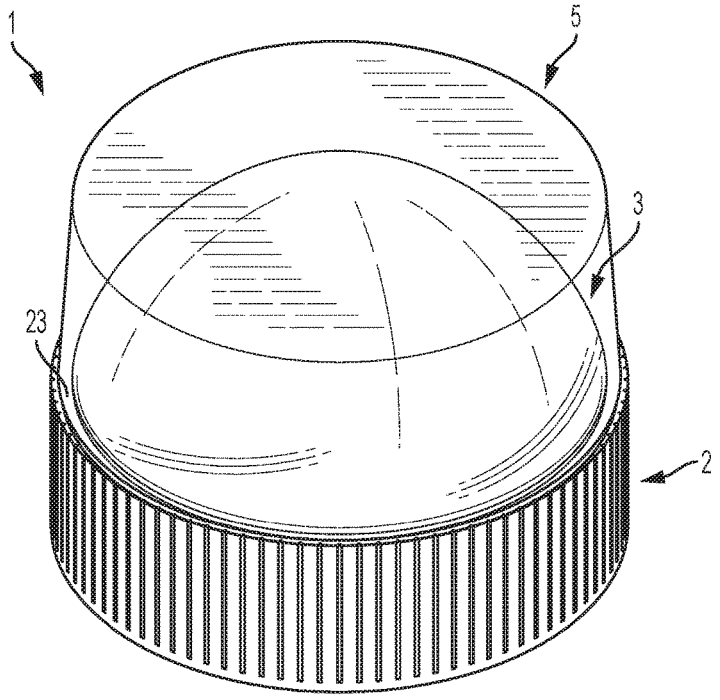
FIG. 2 is a perspective view of one embodiment of the capsule in an assembled state.
Figure 3:
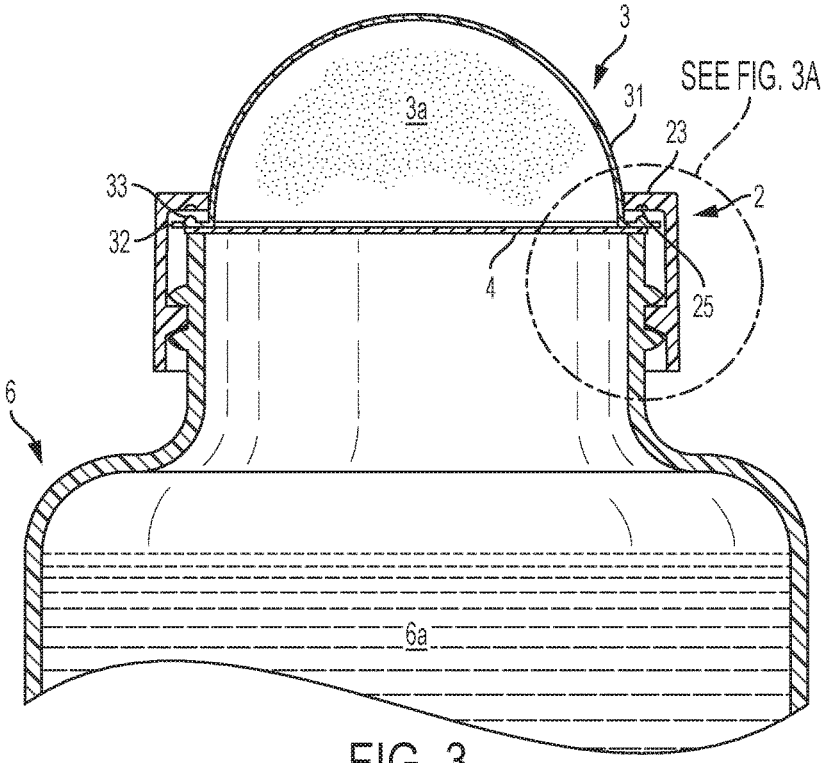
FIG. 3 is cross-sectional view of one embodiment of the capsule attached to a target container, in a pre-actuated state.
Figure 3A:
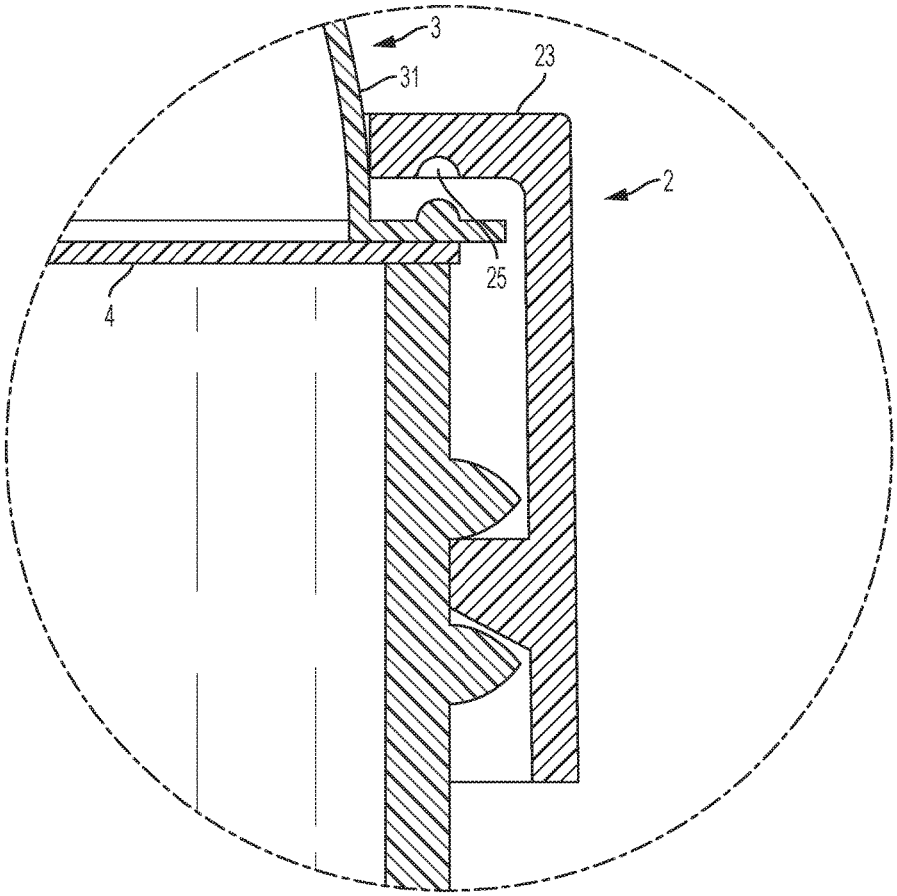
FIG. 3A is close-up cross-sectional view of one embodiment of the capsule attached to a target container, in a pre-actuated state.

With reference to FIGS. 2-3, actuator 3 is received underneath cap body 2 such that perimeter lip 32 engages lip 23 of the cap body 2. More specifically, as shown in close-up FIG. 3A, actuator 3 is received underneath lip 23 of cap body 2 such that annular protrusion 33 is received in annular groove 25 on the underside of the lip 23 of cap body 2. This creates a tight fitment between the actuator 3 and the cap body 2 in order to prevent the actuator 3 from detaching from the cap body 2 during actuation as further described herein. The sealing member 4 is disposed inside of the cap body 2, and in some embodiments is attached underneath across the bottom of the actuator 3. In some embodiments, the sealing member 4 is attached to the underside of the perimeter lip 32 by a heat seal, adhesive or other means. As such, the perimeter lip 32 of the actuator 3 is disposed between the lip 23 of the cap body 2 and the sealing member 4. In an assembled state, the actuator 3 and sealing member 4 are both define a storage chamber that is configured to contain a first ingredient 3*a*.

Figure 4:
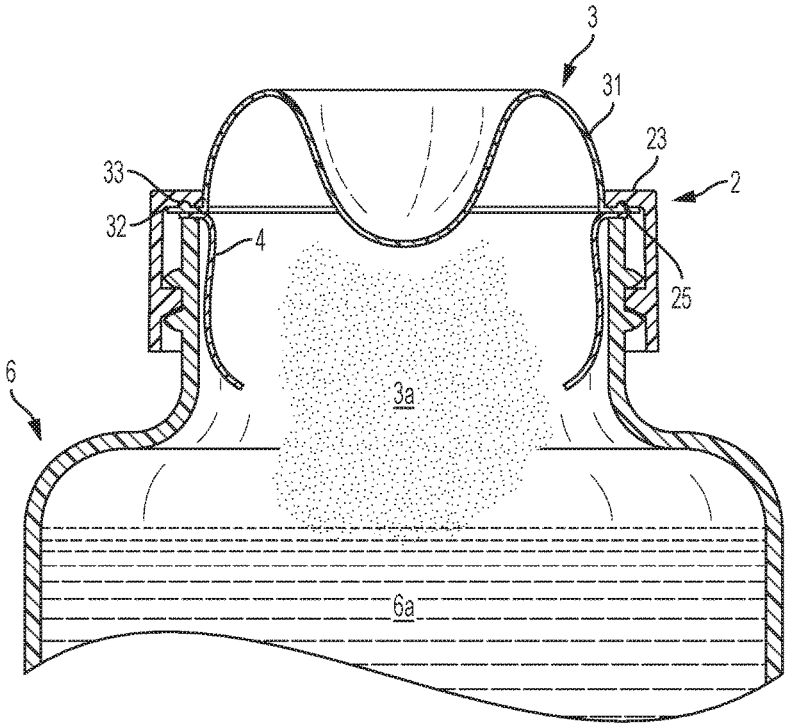
FIG. 4 is a cross-sectional view of one embodiment of the capsule attached to a target container, in an actuated state.

FIGS. 3-4 show the capsule 1 of the present invention attached to a secondary container 6. As shown, cap body 2 is threadingly engaged to container 6 by way of threads 22. Container 6 may also contain a second ingredient 6*a* with which the ingredient 3*a* in the chamber of the capsule 1 is mixed. Here, cover 5 is removed from the top of the cap body 2 and is not shown. The sealing member 4 is intact as the capsule 1 is shown in its pre-activation state. To activate the capsule 1, the user applies manual pressure to the top of actuator 3. This force causes the relatively flexible actuator 3 to deform inward and the chamber therefore compresses somewhat causing a pressure build up inside chamber. The pressure build up is such that it is sufficient to cause sealing member 4 to rupture therefore dispensing first ingredient 3*a* downward and into container 6. At that point, first ingredient 3*a* can mix with second ingredient 6*a*, capsule 1 can be removed from container 6 and the now-mixed ingredients can be accessed. In some embodiments, a line of weakening may be present on sealing member 4 to facilitate rupture of sealing member 4 when pressure is applied to the actuator 3. In some embodiments, the bulbous actuator 3 is configured to resilient rebound to its initial position after activation. This promotes complete expellation of the ingredients in the chamber and enhances overall usability. Moreover, the tight fitment between the bulbous actuator 3 and the cap body 2, by way of the groove and protrusion engagement, assures that the actuator 3 will not dislodge from the cap body 2 during or after actuation of the capsule 1.

It is appreciated that the capsule of the present invention can comprise any combination of materials including plastics, rubbers, aluminum, resins, and the like. Further, the capsule 1 may also be sized and shaped to accommodate fitment on any desired container such as bottles, IV bags, pouches, and the like. Furthermore, the threaded engagement with the container may be substituted for various snap-on or other releasable fitments known in the art.

The bulbous actuator 3 may comprise a variety of materials provided such material is sufficiently durable and elastic so as to have a rebounding effect after dispensing of the ingredients from the internal chamber of the capsule 1. Accordingly, in some embodiments, bulbous actuator 3 comprises a thermoplastic polyurethane (TPU) material that can be presented in a variety of colors, shapes, and sizes without departing from the functionality of the invention described herein. It is further appreciated that the sealing member 4 may comprise a variety of plastic and foil-like materials. In some embodiments, the sealing member 4 comprises a thin plastic or resin material having one or more lines of weakening to allow for easier selective dispensing of the chamber ingredients 3*a*. In other embodiments, the sealing member 4 may comprise a foil or paper material equally suitable to be broken by the action described above.

The chamber of the capsule can contain any liquid, powder and or gas and or micro/nano encapsulation in any combination desired. The dispensing capsule 1 can be mounted or applied at any location of a container including a bottle, pouch, can, IV bag, drum or tote. In some embodiments, the capsule is suited to be received on the threaded opening of such containers in order to provide a leak-free fitment. The chamber of the dispensing capsule stores any desired ingredient and may be dimensioned as desired to fit a variety of applications. The size and shape of the capsule of the present invention should not be construed as limited to the sizes and shapes shown in the drawings herein. Rather, the volume of the chamber 6 and the diameter of the various components can vary as desired and/or can vary depending on the size and shape of the intended container or other parameters. Further, the chamber need not be filled completely, but rather can accept any volume of an ingredient desired depending on mixing parameters and the desired final product.

By way of example only, the device can be used for drinks, hair care, pet products, drugs, over the counter medications, cleaning products, soups, dressings, nitrogen, fuels and engine cleansing, oils, waxes, pH enhancers, oral care, oxygen, adhesives and other categories of use depending on the ingredients and formulas. Also a coating of any type of moisture absorbent can be applied to the inside of the chamber to act as a desiccant and allow for moisture absorption of any excess moisture that may be contained inside the invention when filled and sealed.

This dispensing capsule 1 can be molded in one or two pieces thus eliminating a high cost to manufacture other dispensing caps that are multiple pieces and difficult to fill and seal the ingredients desired. Furthermore, due to the encapsulated capsule excluding the sealing area the invention allows the ingredients to remain moisture free and have an unusually long shelf life and allowing with the sealed chamber to combine liquids and powders and oils and other ingredients to be sealed and stored separately if desired to prevent any reaction with one another. Also the device can include multiple applicators such as drinking spouts, pouring spouts and removable dosing cap for use of a product that has flow through to allow dispersing of all ingredients into a desired container. The exact configuration of such spouts and applications is not limited only to those designs shown in figures herein.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A dispensing capsule, comprising:

a cap body, a hemispherically-shaped, flexible bulbous actuator, and a sealing member;

said hemispherically-shaped, flexible bulbous actuator attached to the underside surface of said cap body;

said sealing member disposed in said cap body adjacent to a bottom portion of said bulbous actuator;

said actuator and said sealing member defining an ingredient storage chamber; and wherein said sealing member is configured to rupture upon application of force to said bulbous actuator causing an ingredient in said ingredient storage chamber to be dispensed from said capsule;

wherein said cap body further includes a cap body lip having an underside annular groove wherein said hemispherically-shaped, flexible bulbous actuator is attached to an underside of said cap body lip and said sealing member is attached across a perimeter lip of said hemispherically-shaped, flexible bulbous actuator, wherein said hemispherically-shaped, flexible bulbous actuator includes a perimeter lip having an annular protrusion, said annular protrusion attached within said annular groove on said underside of said lip of said cap body.

2. A dispensing capsule, comprising:

a cap body, a hemispherically-shaped, flexible bulbous actuator, and a sealing member;

said cap body including a cap body lip around a top portion thereof, said cap body lip including an annular groove around the underside thereof;

said hemispherically-shaped, flexible bulbous actuator including a perimeter lip around a bottom portion thereof, said perimeter lip including an annular protrusion extending upward therefrom;

said hemispherically-shaped, flexible bulbous actuator attached to said cap body such that said annular protrusion of said hemispherically-shaped, flexible bulbous actuator is attached within said annular groove of said cap body;

said sealing member disposed across said bottom portion of said hemispherically-shaped, flexible bulbous actuator, such that said perimeter lip of said hemispherically-shaped, flexible bulbous actuator disposed between said sealing member and said lip of said cap body;

said actuator and said sealing member defining an ingredient storage chamber; and wherein said sealing member is configured to rupture upon application of force to said hemispherically-shaped, flexible bulbous actuator causing an ingredient in said ingredient storage chamber to be dispensed from said capsule.

3. The dispensing capsule of claim 2 wherein said cap body is configured to be removably attached to a secondary container such that said ingredient in said ingredient storage chamber is dispensed into said secondary container.

4. The dispensing capsule of claim 3, wherein said cap body includes internal threads to engage said secondary container.

5. The dispensing capsule of claim 2, further including a cover received over said bulbous actuator and removably attached to said cap body.

* * * * *